United States Patent [19]

Raad et al.

[11] Patent Number: 4,748,337

[45] Date of Patent: May 31, 1988

[54] PRIME MOVER STARTING SYSTEM AND METHOD

[75] Inventors: Bernard A. Raad; Jeffrey D. Baldwin; Clarence F. Dolan, all of Rockford, Ill.

[73] Assignee: Sundstrand Corporation, Rockford, Ill.

[21] Appl. No.: 63,296

[22] Filed: Jun. 17, 1987

[51] Int. Cl.[4] ..... F02N 11/04

[52] U.S. Cl. ..... 290/31; 290/38 R

[58] Field of Search ..... 290/10, 22, 31, 38 R, 290/39 C, 38 E, DIG. 1

[56] References Cited

U.S. PATENT DOCUMENTS

| | | | |
|---|---|---|---|
| 3,867,677 | 2/1975 | Fletcher et al. | 318/137 |
| 3,908,130 | 9/1975 | Lafuze | 290/31 X |
| 4,093,869 | 6/1978 | Hoffmann et al. | 290/31 |
| 4,330,743 | 5/1982 | Glennon | 290/38 R X |
| 4,473,752 | 9/1984 | Cronin | 290/38 R |
| 4,481,459 | 11/1984 | Mehl et al. | 322/10 |
| 4,697,090 | 9/1987 | Baker et al. | 290/38 R X |

*Primary Examiner*—William M. Shoop, Jr.

*Assistant Examiner*—W. E. Duncanson, Jr.

*Attorney, Agent, or Firm*—Wood, Dalton, Phillips, Mason & Rowe

[57] ABSTRACT

A starting system for starting a prime mover connected to a generator by a torque link includes an induction motor having a torque rating substantially equal to the minimum torque required to rotate the rotor of the generator from rest to a particular speed within a predetermined time period while the torque link is deactuated, a source of electrical power, contactors for connecting the source of electrical power to the induction motor when the torque link is deactuated to accelerate the generator rotor to the particular speed, a second set of contactors for connecting the source of electrical power to the generator windings once the generator rotor has reached a particular speed to cause the generator to operate as a synchronous motor and a torque link actuator for actuating the torque link once the generators operating as a synchronous motor to bring the prime mover up to starting speed. The usual large magnitude transient developed in the source of electrical power is thus broken down into three transients of lesser magnitude.

10 Claims, 2 Drawing Sheets

PRIME MOVER STARTING SYSTEM AND METHOD

TECHNICAL FIELD

The present invention relates generally to starting systems and methods, and more particularly to a system and method for starting a prime mover using a generator.

BACKGROUND ART

Often, prime movers are used to provide motive power to a generator which in turn converts the motive power into electrical power for energizing loads. Typically, the prime mover is started by a dedicated starter motor or by operating the generator itself as an induction motor to develop the necessary torque level for starting the prime mover. However, the former approach unduly increases system size and weight while the latter gives rise to large transients in the AC power which must be supplied to the generator to cause it to operate as a motor. The magnitude of the transient may be such as to render portable power supplies, such as ground power carts, unsuitable for this use.

Fletcher et al U.S. Pat. No. 3,867,677 discloses a starting system for a synchronous motor which drives a generator. An induction starting motor is provided AC power to accelerate the rotors of the synchronous motor and the generator. Electrical power is thereafter supplied to the synchronous motor to cause it to supply motive power to the generator. By rotating the synchronous motor before applying power thereto, large power line disturbances are said to be prevented.

Fletcher et al also discloses a circuit for operating the motor at unity power factor. A phase comparator compares the phase of the input voltage to the phase of the input current to develop an error signal which controls the motor field to keep the motor at unity power factor.

The Fletcher et al system, however, cannot reduce power line disturbances to a great extent since the synchronous motor and generator rotors are both accelerated by the induction starting motor prior to the application of electrical power to the synchronous motor. This high-inertia load on the induction starting motor results in a significant transient at the time the AC power is supplied to the induction motor.

Mehl et al U.S. Pat. No. 4,481,459, assigned to the assignee of the instant application, discloses a starting-/generating system and method wherein a brushless generator is connected by a torque converter to a prime mover. When it is desired to start the prime mover, a permanent magnet generator of the brushless type is provided electrical power to bring the rotor of the brushless generator up to a predetermined speed. Once this predetermined speed is reached, the main generator windings of the brushless generator are provided power to operate the brushless generator as a motor and thereby develop motive power. The torque converter is then actuated so that the motive power is returned through the torque converter to the prime mover to bring it up to self-sustaining speed.

Cronin U.S. Pat. No. 4,473,752 discloses a starter-generator machine for starting an aircraft engine. The machine includes a rotor-shaped stator which is fixed within a squirrel-cage induction rotor. The induction rotor in turn includes an array of magnets attached on the outer circumference thereof. The machine is operated as a starter by applying three-phase AC power to windings disposed within the rotor-shaped stator. This in turn accelerates the induction rotor and the permanent magnets. Once a predetermined rotor speed is reached, AC power is applied to stator windings in an outside stator surrounding the rotor to synchronize the rotating magnetic field developed by the permanent magnets with the rotating field created in the stator so that motive power is developed. The motive power is transferred to a prime mover to start same.

DISCLOSURE OF INVENTION

In accordance with the present invention, a starting system and method for starting a prime mover using a generator reduces transients in the AC power supplied to the generator to start a prime mover in a simple and effective fashion.

More particularly, a starting system and method for starting a prime mover connected to a generator having armature and field windings and a rotor includes a torque link disposed between the generator rotor and the prime mover wherein the torque link is actuated or deactuated to drivingly engage or disengage, respectively, the generator rotor and the prime mover. An induction motor having a torque rating substantially equal to the minimum torque required to rotate the generator rotor from rest to a particular speed within a predetermined desired time period while the torque link is deactuated, is mechanially linked to the generator rotor. A source of electrical power is connected to the induction motor when the torque link is deactuated to accelerate the generator rotor to a particular speed. Once the particular speed is reached, the source of electrical power is connected to the generator armature and field windings to cause the generator to operate as a synchronous motor and thereby develop motive power. The torque link is then actuated once the generator is operating as a synchronous motor to bring the prime mover up to starting speed.

The present system and method divides the transient into three portions spaced in time, each with a magnitude substantially less than the magnitude of the transient which would result if power were applied directly to the generator when at rest to cause it to operate as an induction motor. Also, the system does not require complex power converters or specialized machines to effect the starting function.

The present system also includes circuitry for maintaining the generator at unity power factor during operation as a synchronous motor. Sensors are provided for developing signals representing the input current, input voltage and input power to the generator. The input voltage and input current signals are multiplied to develop a signal representing volt-amps and this signal is compared against the input power signal to derive an error signal. In addition, a lead/lag signal is developed by an angle discriminator which senses the phase displacement between the input voltage and input current. The lead/lag signal and the error signal are both used to control the excitation of the generator to maintain the generator at unity power factor.

BEST MODE FOR CARRYING OUT THE INVENTION

Figure 1:
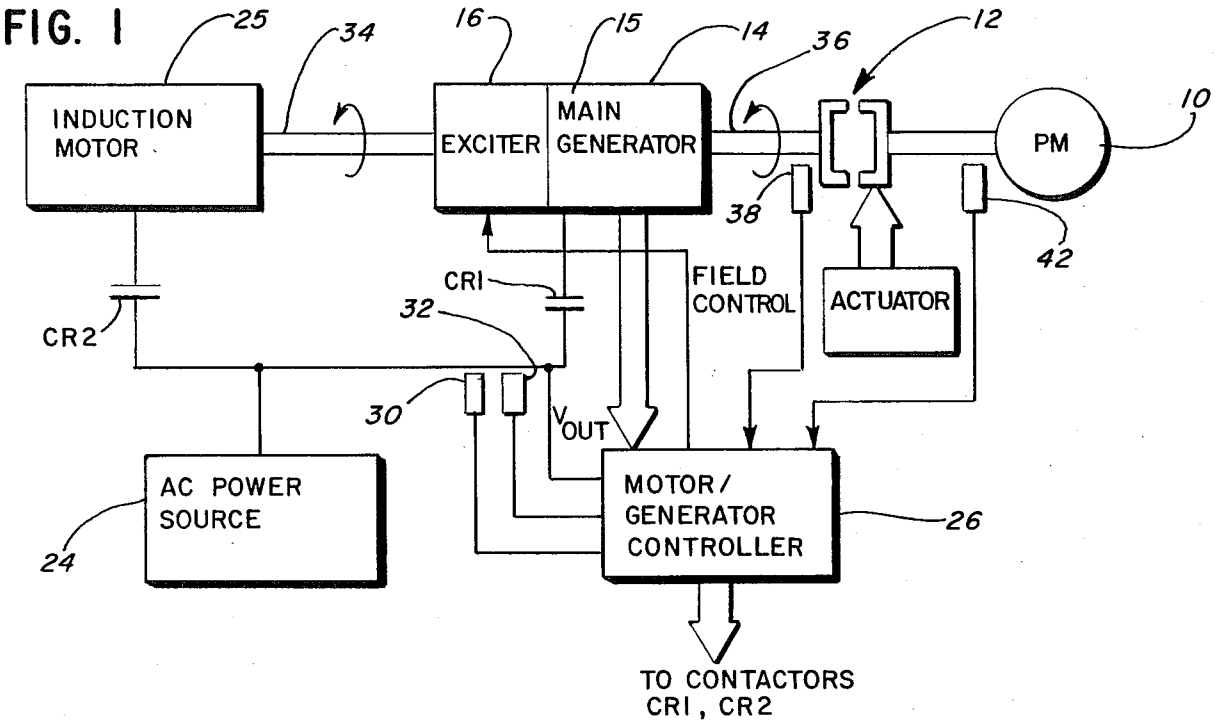
FIG. 1 is a block diagram of the starting system according to the present invention.
Figure 2:
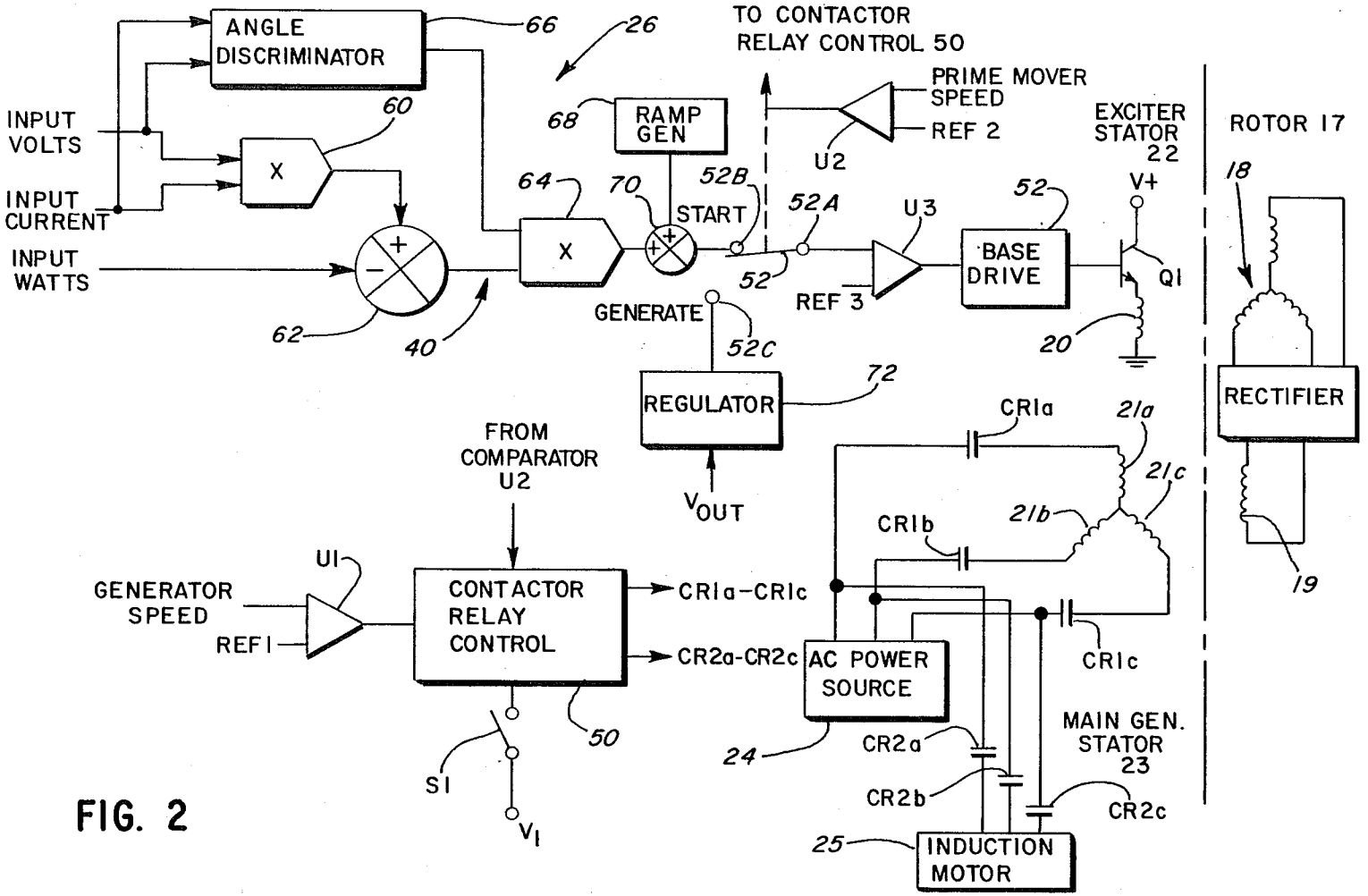
FIG. 2 is a block diagram of the motor/generator controller illustrated in FIG. 1.

Referring now to FIGS. 1 and 2, a prime mover 10 is connected by a torque link 12 to a generator 14 which is preferably of the brushless, synchronous type. The generator 14 may, alternatively, be of the brush type, if desired. The generator 14 includes a main generator 15 and an exciter 16 having a common rotor 17. A set of exciter armature windings 18 and a main generator field winding 19 are disposed on the rotor 17. An exciter field winding 20 and a set of main generator armature windings 21*a*–21*c* are disposed in stators 22, 23 of the exciter 16 and main generator 15, respectively. The main generator armature windings 21*a*–21*c* are selectively coupled by contactors CR1*a*–CR1*c*, respectively, to the output of an AC power source 24. The AC power source 24 is also selectively coupled to an induction motor 25 by contactors CR2*a*–CR2*c*. The contactors CR1 and CR2 and the exciter field winding current are controlled by a motor/generator controller 26 which is responsive to the voltage developed by the AC power source 24 as well as the current and power delivered to the main generator armature windings 21*a*–21*c* as detailed by a current sensor 30 and a watt sensor 32.

In general, the starting method of the present invention includes the steps of opening or deactuating the torque link 12 to decouple the generator 14 from the prime mover 10 and closing the contactors CR2*a*–CR2*c* while the contactors CR1*a*–CR1*c* are open to cause the induction motor 25 to develop rotary motive power at an output shaft 34. The shaft 34 is in turn geared or connected directly to a motive power shaft 36 of the generator 14 so that the shaft 36 and rotor 17 are likewise accelerated toward a predetermined speed. Once the predetermined speed is reached, which may be substantially equal to the synchronous speed of the generator 14 as detected by speed sensor 38, the contactors CR1*a*–CR1*c* are closed so that AC power is provided to the armature windings 21*a*–21*c* by the AC power source 24. At this point, unity power factor control circuitry 40 controls the excitation provided to the field winding 20 so that the generator 14 operates as a synchronous motor at unity power factor.

Once motive power is being developed by the synchronous generator 14, the contactors CR2*a*–CR2*c* may be opened and the torque link 12 may be closed by a manual control or otherwise to transfer the motive power to the prime mover 10 to bring it up to self-sustaining speed. A speed sensor 42 detects when the self-sustaining speed is reached, at which time the contactors CR1*a*–CR1*c* are opened. Output electrical power may thereafter be obtained from the armature windings 21*a*–21*c*.

Referring now more specifically to FIG. 2, a contactor relay control circuit 50 is responsive to a start switch S1 which, when closed, causes the control circuit 50 to close the contactors CR2*a*–CR2*c* and to open the contactors CR1*a*–CR1*c*. The induction motor 25 is sized to provide just enough torque to accelerate the generator motive power shaft 36 and rotor 17 to a predetermined speed within an acceptable or desirable time period. Thus, the size and weight of the induction motor 25 is minimized as is the magnitude of the transient developed in the power supplied by the AC power source 24.

Once substantially synchronous speed is reached, as determined by a comparator U1 which compares the output of the speed sensor 38 against a reference signal REF1, the contactor relay control 50 closes the contactors CR1*a*–CR1*c* and opens the contactors CR2*a*–CR2*c*. Thus, AC power is supplied by the AC power source 24 to the armature windings 21*a*–21*c*. Also, a switch S2 is in a normal position bridging contacts S2A and S2B. The switch S2 is operated by a second comparator U2 which compares the output of the speed sensor 42 representing prime mover speed against a second reference signal REF2 representing prime mover speed self-sustaining speed. During this time, a ramp signal developed by the unity power factor control circuit 40 is coupled by the switch S2 to one input of a pulse-width modulated (PWM) comparator U3 which compares this ramp signal against a reference signal REF3. The resulting pulse-width modulated wave is conditioned by a base drive circuit 52 and applied to the base of a transistor Q1. The transistor Q1 controls the application of a voltage V+ to the exciter field winding 20 in accordance with the PWM wave.

The unity power factor control circuit 40 includes a first multiplier 60 which multiplies signals representing the input voltage and input current to the generator 14. The resulting volt-amp signal is coupled to one input of a summing junction 62. A second input of the summing junction 62 receives a power or watt signal from the watt sensor 32. The summing junction 62 develops an error signal representing the deviation of the input volt-amps from the input watts and couples the signal to an input of a second multiplier 64. A further input of the multiplier 64 receives a bipolar signal from an angle discriminator 66. The angle discriminator 66 is responsive to the input current and input voltage and develops a signal at a level of +1 volt when the input current leads the input voltage and develops a signal at a −1 volt level when the input current lags the input voltage.

The multiplier 64 develops a DC level which corresponds to the error signal developed by the summing junction 62 and which is of one polarity when the input current leads the input voltage and is of the other polarity when the input current lags the input voltage. The resulting bipolar signal is summed with the output of a ramp generator 68 and is coupled to the terminal S2B of the switch S2.

If the input volt-amps, as detected by the multiplier 60, are equal to the input watts, the error signal developed by the summing junction 62 is zero, in turn leading to a zero output of the multiplier 64. The ramp signal developed by the ramp generator 68 is unmodified by the summing junction 70, in turn maintaining the pulse widths from the PWM amplifier U3 at present levels. However, if there is some variance between the input volt-amps and the input watts, an error signal is developed which is modified in polarity in accordance with the output of the angle discriminator 66 to vary the DC level of the ramp signal appearing at the terminal S2B. This in turn modifies the pulse widths developed by the PWM amplifier U3 to vary the excitation to the field winding 16 to again drive the error signal to zero.

Thus, during the time that the generator 14 is operating as a synchonrous motor, the power factor is maintained at unity by the closed-loop control illustrated in FIG. 2.

Once the prime mover speed reaches self-sustaining speed, the output of the comparator U2 switches to a high state, in turn causing the switch S2 to connect the contact S2A to a contact S2C. The PWM amplifier U3 is thereafter responsive to a ramp signal developed by a conventional regulator 72 which is in turn responsive to the average of the three-phase voltage output of the armature windings 18*a*–18*c*. The generator 14 thereafter operates in the generating mode to convert motive power developed by the prime mover 10 into electrical power.

It should be noted that the regulator 72 does not form any part of the present invention, and hence will not be described in greater detail.

The comparator U2 also is coupled to the contactor relay control 50 and causes the control 50 to open the contactors CR1*a*–CR1*c* when the prime move reaches self-sustaining speed.

If the synchronous generator 14 receives control power from a permanent magnet generator (PMG), the output of the PMG may be sensed by the motor/generator controller 26 to determine the speed of the generator 14. In this case, the speed sensor 38 may be dispensed with. A frequency-to-voltage converter may be necessary, however, to convert the PMG frequency into a voltage signal of appropriate level.

It should also be noted that the torque link 12 may be of any suitable type, such as a torque converter, a clutch or other controllable device. Further, the motor/generator controller 26 may be designed in a straightforward fashion using logic components.

Figure 3:
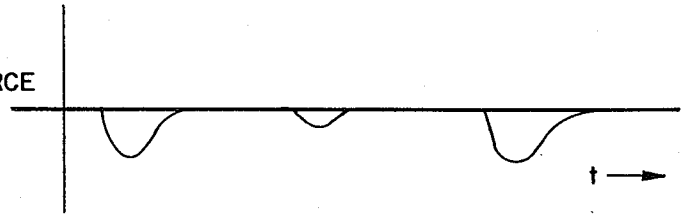
FIG. 3 is a waveform diagram illustrating the output voltage of the power source 20 shown in FIGS. 1 and 2 during starting of the prime mover 10.

Referring now to the waveform diagrams of FIG. 3, the effect of the present starting method on the AC power source 24 is seen to consist of a total of three transients or disturbances in the AC power. The first transient occurs when the AC power source 24 is connected to the induction motor 25 by means comprising the motor/generator controller 26 and the contactors CR2*a*–CR2*c*. By selecting an induction motor which supplies just enough torque to accelerate the generator shaft 36 within an acceptable period of time, not only the size and weight of the induction motor 25 may be minimized but also the magnitude of the transient developed at this time.

The second transient is developed when the AC power source 24 is connected to the armature windings 21*a*–21*c* by means comprising the motor/generator controller 26 and the contactors CR1*a*–CR1*c*, at which time the shaft 36 of the generator 14 is pulled into synchronism with the electrical power applied to the armature windings 21*a*–21*c*.

The third transient occurs when the torque link 12 is closed. Obviously, the magnitude and duration of this transient may be varied by controlling the torque link 12 in a desired fashion.

It can therefore be seen that the usual single transient of large magnitude encountered with the prior art is avoided, and in its place a series of three transients are developed in the AC power source 24 each of a magnitude much less than that encountered in the prior art. Thus, the AC power source 24 may comprise, for example, a ground power art typically used in aircraft applications or another portable source of power, as desired.

We claim:

1. A starting system for starting a prime mover connected to a generator having armature and field windings and a rotor, comprising:

a torque link disposed between the generator rotor and the prime mover wherein the torque link is actuated or deactuated to drivingly engage or disengage, respectively, the generator rotor and the prime mover;

an induction motor having a torque rating substantially equally to the minimum torque required to rotate the generator rotor from rest to a particular speed within a predetermined time period while the torque link is deactuated;

a source of electrical power;

first means for connecting the source of electrical power to the induction motor when the torque link is deactuated to accelerate the generator rotor to the particular speed; and second means for connecting the source of electrical power to the generator armature and field windings once the generator rotor has reached the particular speed to cause the generator to operate as a synchronous motor;

whereby the torque link is actuated once the generator is operating as a synchonrous motor to bring the prime mover up to starting speed.

2. The starting system of claim 1, further including a circuit for maintaining the power factor of the generator substantially at unity while the generator is operating as a synchronous motor.

3. The starting system of claim 2, wherein the maintaining means includes a current sensor which develops a current signal representing input current to the generator and a multiplier for multiplying the current signal with a voltage signal representing the input voltage to the generator to derive a volt-amp signal representing input volt-amps.

4. The starting system of claim 3, wherein the maintaining means further includes a power sensor for developing a power signal representing input watts delivered to the generator and a summing junction having inputs coupled to the multiplier and to the power sensor which compares the power signal with the volt-amp signal to derive an error signal.

5. The starting system of claim 4, wherein the maintaining means further includes a PWM comparator for pulse-width modulating the power delivered to the generator field winding when the generator is operating as a synchronous motor in accordance with the error signal.

6. The starting system of claim 5, further including an angle discriminator for developing a lead/lag signal representing whether the input current leads or lags the input voltage, a second multiplier having inputs coupled to the angle discriminator and the summing junction and an output coupled to the PWM comparator and a second summing junction for summing the output of the second multiplier with a ramp wave wherein the PWM comparator compares the output of the second summing junction with a reference to derive a pulse-width modulated wave.

7. A method of bringing a prime mover up to a self-sustaining speed using a synchronous generator coupled by a selectively actuable torque link to the prime mover, the method comprising the steps of:

deactuating the torque link so that a rotor of the generator can rotate independently of the prime mover;

utilizing an induction starting motor to accelerate the generator rotor to near-synchronous speed;

applying AC power to the generator to cause the generator to operate as a synchronous motor; and actuating the torque link so that motive power developed by the generator is transferred through the torque link to the prime mover to start same.

8. The method of claim 7, further including the step of controlling the generator during operation as a synchronous motor to maintain the power factor thereof at unity.

9. The method of claim 8, wherein the step of controlling includes the steps of developing signals representing the input current and input power to the generator during operation as a synchronous motor, multiplying a signal representing the input voltage to the generator with the input current signal to derive a volt-amp signal and comparing the volt-amp signal with the input power signal to derive an error signal.

10. The method of claim 9, wherein the step of controlling further includes the steps of developing a lead/-lag signal representing whether the input current leads or lags the input voltage and modulating the AC power applied to the generator in accordance with the error signal and the lead/lag signal.

* * * * *